US009531063B2

(12) United States Patent
Andrenko

(10) Patent No.: US 9,531,063 B2
(45) Date of Patent: Dec. 27, 2016

(54) PLANAR INVERTED-F ANTENNA

(71) Applicant: FUJITSU LIMITED, Kawasaki-shi, Kanagawa (JP)

(72) Inventor: Andrey S Andrenko, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 271 days.

(21) Appl. No.: 14/023,587

(22) Filed: Sep. 11, 2013

(65) Prior Publication Data

US 2014/0139383 A1 May 22, 2014

(30) Foreign Application Priority Data

Nov. 19, 2012 (JP) ..... 2012-253565

(51) Int. Cl.
*H01Q 1/27* (2006.01)
*H01Q 1/40* (2006.01)
*H01Q 9/04* (2006.01)

(52) U.S. Cl.
CPC ..... *H01Q 1/273* (2013.01); *H01Q 1/40* (2013.01); *H01Q 9/0421* (2013.01)

(58) Field of Classification Search
CPC ..... H01Q 1/273
USPC ..... 343/718
See application file for complete search history.

(56) References Cited

U.S. PATENT DOCUMENTS 5,861,019 A 1/1999 Sun et al.
6,343,208 B1 * 1/2002 Ying ..... H01Q 1/243 343/702
6,377,142 B1 * 4/2002 Chiu ..... H01P 1/181 333/161
6,542,126 B2 4/2003 Bahr et al.
7,375,686 B2 5/2008 Ku et al.
7,903,043 B2 3/2011 Rawat et al.
2006/0145927 A1 7/2006 Choi et al.
(Continued)

FOREIGN PATENT DOCUMENTS

CN 1901278 A 1/2007
EP 1168495 A2 1/2002
(Continued)

OTHER PUBLICATIONS

Extended European Search Report dated Jan. 7, 2014 for corresponding European Application No. 13185731.0.
(Continued)

*Primary Examiner* — Dameon E Levi
*Assistant Examiner* — Walter Davis
(74) *Attorney, Agent, or Firm* — Fujitsu Patent Center

(57) ABSTRACT

The planar inverted-F antenna includes a first substrate made of a dielectric material, a grounding electrode disposed on a first surface of the first substrate; an emitting electrode disposed to be opposite to the grounding electrode so as to sandwich the first substrate, wherein the emitting electrode has an S-shape, and has a short-circuiting point short-circuited to the grounding electrode at an edge portion thereof, and a feed point at which power is fed and which is located away from the short-circuiting point by a distance at which the characteristic impedance of the planar inverted-F antenna for electric waves with a certain design wavelength has a certain value; and a second substrate disposed to cover the entire emitting electrode together with the first substrate and made of a dielectric material.

3 Claims, 7 Drawing Sheets

(56) References Cited

U.S. PATENT DOCUMENTS

| | | | | |
|---|---|---|---|---|
| 2010/0019985 | A1* | 1/2010 | Bashyam ..... | A61B 5/0031 343/873 |
| 2010/0168817 | A1 | 7/2010 | Yamamoto et al. | |

FOREIGN PATENT DOCUMENTS

| | | |
|---|---|---|
| JP | 2001-053535 | 2/2001 |
| JP | 2002-43833 | 2/2002 |
| JP | 2002-533001 | 10/2002 |
| JP | 2006-505973 | 2/2006 |
| JP | 2006-074351 | 3/2006 |
| JP | 2012-514418 | 6/2012 |
| WO | 2004/042868 | 5/2004 |
| WO | WO-2010/051249 A1 | 5/2010 |

OTHER PUBLICATIONS

Jaehoon Kim et al., "Implanted Antennas Inside a Human Body: Simulations, Designs, and Characterizations", IEEE Transactions on Microwave Theory and Techniques, vol. 52, No. 8, pp. 1934-1943, Aug. 2004.

CNOA—Office Action of Chinese Patent Application No. 201310461591.8 dated Jun. 2, 2015, with English Translation of the Office Action. **US2010/019985A1 listed in the above listed CNOA was previously cited by the Examiner on Jun. 16, 2015.

CNOA—Office Action of Chinese Patent Application No. 201310461591.8 dated Dec. 23, 2015, with English translation of the Office Action.

CNOA—3rd Notification of Office Action of Chinese Patent Application No. 201310461591.8 dated Apr. 25, 2016, with English translation.

JPOA—Office Action of Japanese Patent Application No. 2012-253565 dated May 31, 2016, with English translation.  US201010019985 cited in the above listed JPOA was previously submitted in the IDS filed on Mar. 11, 2014.  JP2001-53535 cited in the above listed JPOA was previously submitted in the IDS filed on Sep. 11, 2013.

* cited by examiner

PLANAR INVERTED-F ANTENNA

CROSS-REFERENCE TO RELATED APPLICATION

This application is based upon and claims the benefit of priority of the prior Japanese Patent Application No. 2012-253565, filed on Nov. 19, 2012, the entire contents of which are incorporated herein by reference.

FIELD

The present invention relates to, for example, a planar inverted-F antenna suitable for implanting into a living body.

BACKGROUND

Recently, research and development relating to communication systems used for sending and receiving various types of information to and from a communication device implanted in a living body, such as a body area network are being carried out. An antenna used for a communication device implanted in a living body such as the human body or animal body is preferably as compact and thin as possible. Loss of electric waves is large in a living body. Therefore, an antenna used for a communication device implanted in a living body is desired to be capable of communicating with other communication devices even in such a medium as a living body causing large electric wave loss.

In order to downsize an antenna, there have been proposed antennas each equipped with an emitting electrode folded at one or more portions thereof (Refer to, for instance, Published Japanese Translation of PCT International Publication for Patent Application (Kohyo) No. 2006-505973, Published Japanese Translation of PCT International Publication for Patent Application (Kohyo) No. 2002-533001, Japanese Laid-Open Patent Publication No. 2001-53535 and Japanese Laid-Open Patent Publication No. 2006-74351). These antennas are, however, have not been implanted in a living body for use thereof. Therefore, with the antennas as described above, it is impossible to reduce negative effects caused by electric wave loss in a living body, and the antennas are not suitable for use together with communication devices implanted in a living body.

On the other hand, there have also been proposed antennas which are implanted in a living body (Refer to, for instance, Published Japanese Translation of PCT International Publication for Patent Application (Kohyo) No. 2012-514418 and J. Kim et. al., "Implanted Antennas Inside a Human Body: Simulations, Designs, and Characterizations", IEEE MTT Trans, vol. 52, no. 8, pp. 1934-1943). In each of the antennas, in order to match the impedance of the antenna with that of a living body, an emitting electrode of the antenna is covered with a dielectric material. In the antennas, the emitting electrode is folded so as to be compact.

SUMMARY

However, it is preferable to make an antenna as compact as possible for the purpose of reducing a load to a living body.

According to an embodiment, a planar inverted-F antenna is provided. The planar inverted-F antenna includes a first substrate made of a dielectric material; a grounding electrode disposed on a first surface of the first substrate; an emitting electrode disposed to be opposite to the grounding electrode so as to sandwich the first substrate, formed into an S-shape, and having a short-circuiting point short-circuited to the grounding electrode located on an end of the emitting electrode, and a feeding point at power is fed and which is located away from the short-circuiting point with a distance where the characteristic impedance of the planar inverted-F antenna to electric waves having a certain designed wavelength is a certain value; and a second substrate provided to cover the entire emitting electrode and made of a dielectric material.

The object and advantages of the present invention will be realized and attained by means of the elements and combinations particularly indicated in the claims.

It is to be understood that both the foregoing general description and the following detailed description are exemplary and explanatory and are not restrictive of the invention, as claimed.

DESCRIPTION OF EMBODIMENTS

Description is provided below of a planar inverted-F antenna (PIFA) according to various embodiments with reference to the drawings attached hereto.

In each of the PIFAs described hereinafter, for matching the impedance of a living body in which the PIFA is implanted with that of the PIFA, the entire surface of an emitting electrode is covered with a dielectric material. Furthermore, in the PIFA, for reducing negative effects to the living body, also the entire surface of the grounding electrode is covered with an insulator. In addition, since the emitting electrode is in the form of an S-shape, it is possible to make the emitting electrode compact, which in turn makes the PIFA compact.

Figure 1:
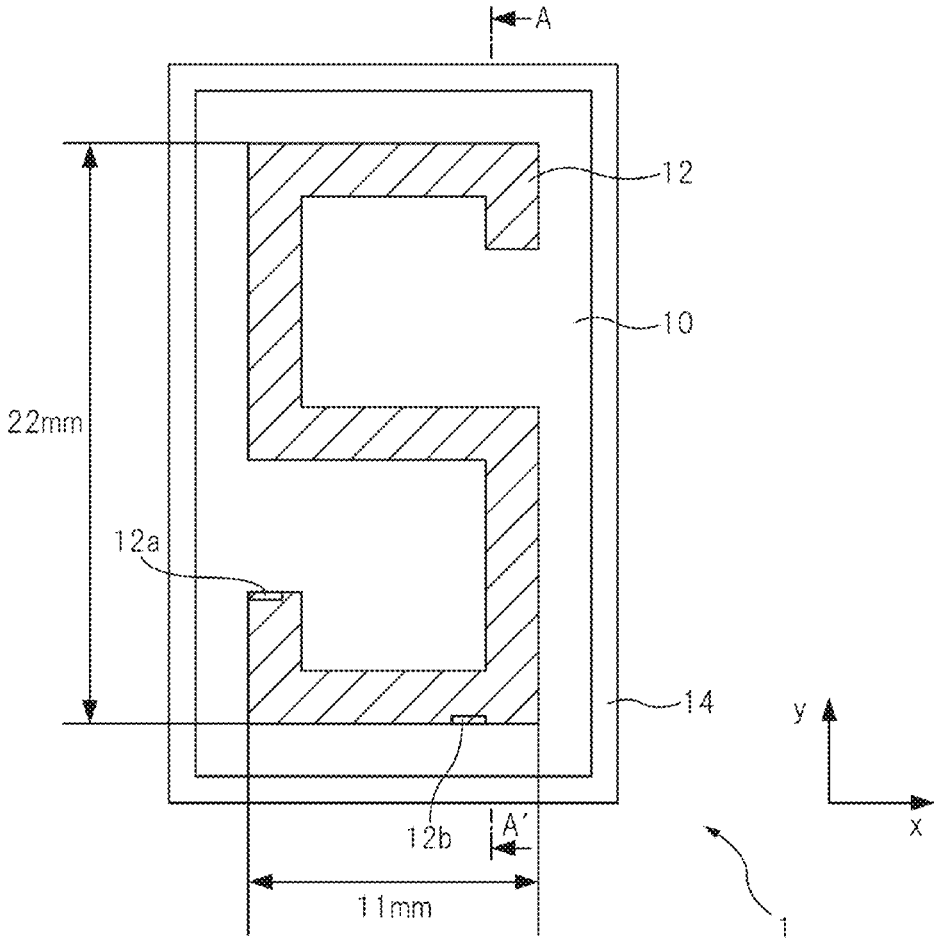
FIG. 1 is a transparent plan view illustrating the top surface of a planar inverted-F antenna according to an embodiment.
Figure 2:
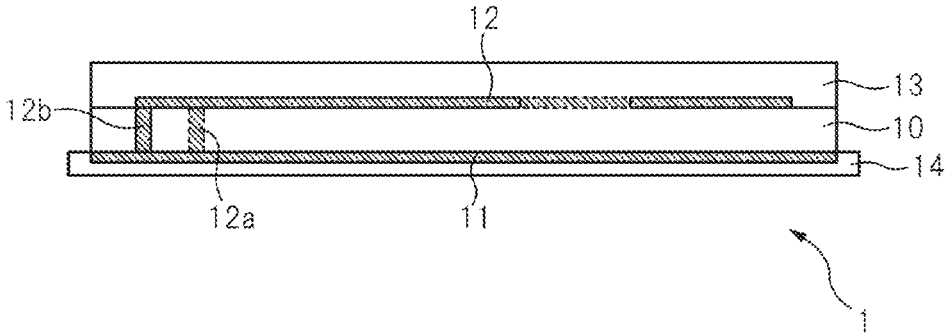
FIG. 2 is a cross-sectional side view illustrating the planar inverted-F antenna along line AA' in FIG. 1 and viewed in the direction represented by an arrow head.

FIG. 1 is a transparent plan view illustrating a surface of a substrate in a PIFA 1 according to one embodiment, and FIG. 2 is a cross-sectional side view illustrating the PIFA 1 cut along line AA' in FIG. 1 and viewed in the direction represented by an arrow head. For convenience of description, it is assumed herein that the horizontal direction in FIG. 1 is the x-axial direction and the vertical direction is the y-axial direction. Furthermore, it is assumed that the vertical direction to the surface of the PIFA 1 is the z-axial direction. It is assumed, for convenience of description, that a plane parallel to the surface of the PIFA 1 is the horizontal plane.

The PIFA 1 includes a substrate 10, a grounding electrode 11 disposed on the bottom surface of the substrate 10, and an emitting electrode 12 which is disposed on the top surface of the substrate 10 and which is opposed to the grounding electrode 11 so as to sandwich the substrate 10. Furthermore, the PIFA 1 includes a superstrate 13 superimposed on the substrate 10 so as to sandwich the emitting electrode 12 and cover the entire surface of the emitting electrode 12, and an insulating material layer 14 disposed under the substrate 10 so as to sandwich the grounding electrode 11 and cover the entire grounding electrode 11. The PIFA 1 is implanted in a living body so that, for instance, the top surface of the substrate 10 is closer to a surface of the living body than the bottom surface of the substrate 10 and the top surface of the substrate 10 is substantially parallel to the surface of the living body. A communication circuit (not illustrated) for sending or receiving electric waves using the PIFA 1 is positioned, for instance, under the bottom surface of the insulating material layer 14. This communication circuit may be covered with an insulating material.

The substrate 10 supports the grounding electrode 11 and the emitting electrode 12. The substrate 10 is made of, for instance, a dielectric material including glass and ceramics. Alternatively, the substrate 10 may be made of another dielectric material suitable for superimposing and excellent in biocompatibility such as acrylic resin. The thickness of the substrate 10 is decided so that the characteristic impedance of the PIFA 1 is a certain value such as 50Ω or 75Ω.

The grounding electrode 11 is a planar conductor connected to ground, and in this embodiment, the grounding electrode 11 covers the entire bottom surface of the substrate 10.

The larger the area of the grounding electrode 11 is, the lower is the frequency of electric wave, at which the impedance of the PIFA 1 matches with that of the living body in which the PIFA 1 is implanted. Therefore, the size of the grounding electrode 11 may be designed according to a design wavelength of the electric wave transmitted from or received by the PIFA 1.

The emitting electrode 12 is a slender and planar conductor disposed between the top surface of the substrate 10 and the bottom surface of the superstrate 13. In this embodiment, the emitting electrode 12 is in the form of an S-shape, and an edge 12*a* thereof functions as a short-circuiting point connected, for instance, through a via hole formed on the substrate 10 to the grounding electrode 11. A feed point 12*b* is provided at a position away from the short-circuiting point 12*a* by a distance at which the characteristic impedance of the PIFA 1 is a certain value (such as 50Ω or 75Ω) for the design wavelength of the electric wave transmitted from or received by the PIFA 1. The emitting electrode 12 is connected at the feed point 12*b*, for instance, through a via hole formed on the substrate 10 to the grounding electrode 11 and is electrically fed. The length from the feed point 12*b* to the other edge point of the emitting electrode 12 is set to substantially one fourth of the design wavelength. With the features described above, the substrate 10, the grounding electrode 11, and the emitting electrode 12 operate, as a whole, as a planer inverted-F antenna.

Since the emitting electrode 12 is in the form of an S-shape, both the x-axial and y-axial lengths are shorter than one fourth (¼) of the design wavelength. Because of the form, three portions of the emitting electrode 12, which are different from each other, are included within a certain width along the x-axial direction, and therefore the size of the emitting electrode 12 on the horizontal surface 12 is small.

Furthermore, both edges of the emitting electrode 12 are folded along the y-axial direction so that the short-circuiting point 12*a* and the other edge portion of the emitting electrode 12 are opposed to each other. Therefore, the size of the emitting electrode 12 in the x-axial direction becomes smaller. Because of the features described above, it is possible to downsize the PIFA 1. For instance, when the PIFA 1 transmits and receives electric wave with the frequency in a 400 MHz band, which is one of the frequency bands used in a body area network, as illustrated in FIG. 1, the length of the emitting electrode 12 in the x-axial direction is 11 mm, while the length of the emitting electrode 12 in the y-axial direction is 26 mm.

It is to be noted that the grounding electrode 11 and the emitting electrode 12 are made of, for instance, metal such as aluminum, copper, gold, silver, or nickel, an alloy of the metals, or other materials having conductivity.

The superstrate 13 matches the impedance of the PIFA 1 to that of a living body in which the PIFA 1 is implanted. For the purpose thereof, the superstrate 13 is made of a dielectric material including glass and ceramics. The superstrate 13 may be made of other dielectric material suited to superimposing and excellent in biocompatibility such as acrylic resin.

It is to be noted that the substrate 10 and the superstrate 13 may be made of the same dielectric material or of different dielectric materials respectively.

The thickness of the superstrate 13 is decided so that the impedance of the PIFA 1 matches to that of a living body in which the PIFA 1 is implanted. Effects of the thickness of the superstrate 13 over matching between the impedance of the PIFA 1 and that of a living body will be described below.

Figure 3:
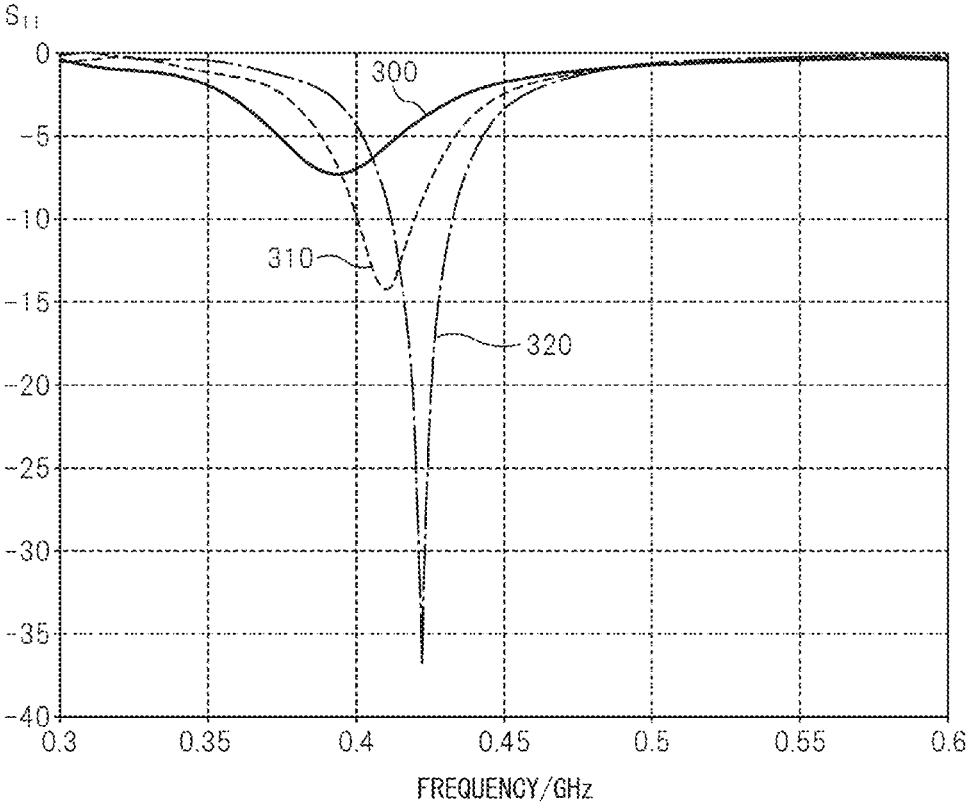
FIG. 3 is a view illustrating results of simulations for an S parameter of the planar inverted-F antenna when the thicknesses of the superstrate are 0.5 mm, 1 mm, and 1.5 mm respectively.

FIG. 3 is a view illustrating results of simulations for an S parameter of the PIFA 1 when the thicknesses of the superstrate are 0.5 mm, 1 mm, and 1.5 mm, respectively. In this simulation, the dielectric constant of the substrate 10 and that of the superstrate 13 are 10.2 respectively, and the thickness of the substrate 10 is 1.5 mm. The thickness of the insulating material layer 14 is 0.5 mm, and the dielectric constant of the insulating material layer 14 is 2.5. The PIFA 1 has a dielectric constant of 46.7 and the PIFA 1 is implanted between a living body layer with a thickness of 5 mm and a living body layer with a thickness of 10 mm with a dielectric tangent of 0.69 S/m.

In FIG. 3, the horizontal axis indicates a frequency [GHz], while the vertical axis indicates a value of $S_{11}$ parameter [dB]. Graph 300 indicates the frequency characteristic of $S_{11}$ parameter of the PIFA 1 when the thickness of the superstrate 13 is 0.5 mm. Graph 310 indicates the frequency characteristic of $S_{11}$ parameter of the PIFA 1 when the thickness of the superstrate 13 is 1.0 mm. Graph 320 indicates the frequency characteristic of $S_{11}$ parameter of the PIFA 1 when the thickness of the superstrate 13 is 1.5 mm.

It is to be noted that each of the frequency characteristics was calculated by the electric field analysis using the finite element method.

As illustrated by graphs 300 to 320, the thicker the superstrate 13 is, the better the impedance of the PIFA 1 matches to the impedance of the living body in which the PIFA 1 is implanted. The thicker the superstrate 13 is, the higher the frequency of electric wave is at which the impedance of the PIFA 1 matches best with the impedance of the living body in which the PIFA 1 is implanted. This is because, the dielectric constant of a living body is very high, for instance, in the range from 40 to 50, while the dielectric constant of a dielectric body suited to implant in a living body is lower than that of a living body. In this example, the thickness of the superstrate 13 is 0.5 mm, but the thickness of the superstrate 13 may be set to a value, for instance, in the range from 0.5 mm to 1.5 mm, since the value of $S_{11}$ parameter is lower than −6 dB which is a target value for an antenna available for radio communication.

The insulating material layer 14 keeps the grounding electrode 11 insulated from a living body in which the PIFA 1 is implanted. Because of this insulation, negative effects caused by electric waves transmitted from or received by the PIFA 1 can be reduced. For the purpose of efficiently in reducing negative effects by a current flowing in the grounding electrode 11, it is preferable that the dielectric constant of the insulating material layer 14 be lower than the dielectric constant of the substrate 10 and that of the superstrate 13. The insulating material layer 14 is preferably excellent in biocompatibility, because the PIFA 1 is in contact with a living body. Therefore, the insulating material layer 14 is preferably made of, for instance, is a fluororesin.

Figure 4A:
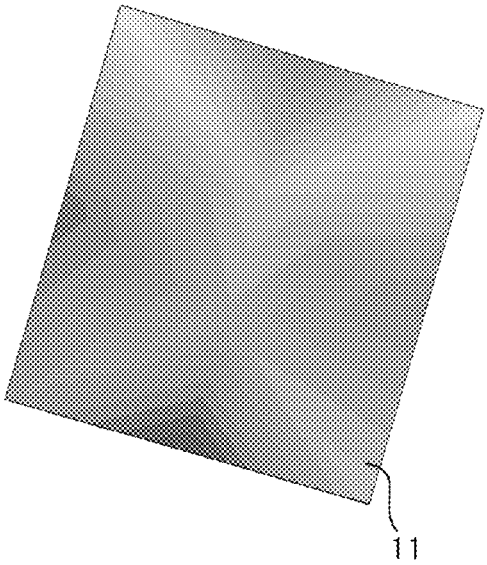
FIG. 4A and FIG. 4B are views illustrating results of simulations for distribution of a current density in the grounding electrode when an insulating material layer is removed from the planar inverted-F antenna and for that when an insulating material layer is present respectively.
Figure 4B:
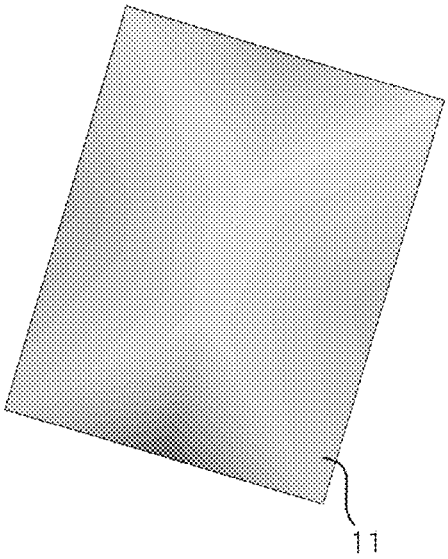

FIG. 4A and FIG. 4B are views illustrating results of simulations, by means of the finite element method, for the distributions of current densities in the grounding electrode 11 when an insulating material layer 14 is removed from the PIFA 1 and when an insulating material layer 14 is present. In the simulations, it is assumed that the PIFA 1 receives an electric wave with a frequency of 424 MHz. The size of the emitting electrode 12 is as illustrated in FIG. 1, and the sizes and physical characteristics of each substrate are the same as those of each substrate in the simulation illustrated in FIG. 3. It is to be noted that the thickness of the superstrate 13 is 1.5 mm.

In FIG. 4A and FIG. 4B, deeper color represents higher current density. As is obvious from the results of the simulations, it can be understood that, when the insulating material layer 14 is present, the current density in the grounding electrode 11 is generally lower.

Figure 5:
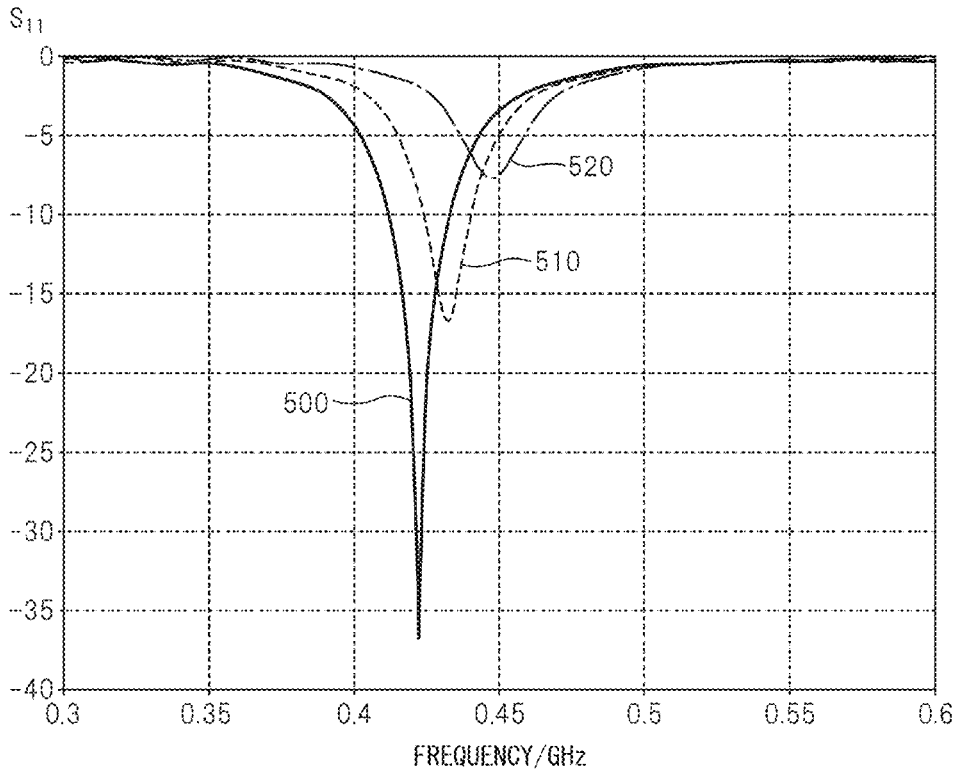
FIG. 5 is a view illustrating results of simulations for an S parameter of the planar inverted-F antenna when various forms of the insulating material layer are employed.

FIG. 5 is a view illustrating results of simulations for an S parameter of the PIFA 1 when various forms of the insulating material layer 14 are employed. In the simulations, the size of the emitting electrode 12 is as illustrated in FIG. 1, and the size and physical characteristics of each substrate are the same as those of each substrate in the simulation illustrated in FIG. 3. The thickness of the superstrate 13 is 1.5 mm.

In FIG. 5, the horizontal axis indicates a frequency [GHz], while the vertical axis indicates a value of $S_{11}$ parameter [dB]. Graph 500 illustrates the frequency characteristics of $S_{11}$ parameter of the PIFA 1 when the insulating material layer 14 is provided under the substrate 10 so that the insulating material layer 14 covers only the grounding electrode 11. Graph 510 illustrates the frequency characteristics of $S_{11}$ parameter of the PIFA 1 when the insulating material layer 14 is formed so that the insulating material layer 14 covers the entire side surface of the PIFA 1, i.e., so that the PIFA 1 covers not only the grounding electrode 11, but also side faces of the emitting electrode 12 and the superstrate 13. Graph 520 illustrates the frequency characteristics of $S_{11}$ parameter of the PIFA 1 when the insulating material layer 14 is formed so that the insulating layer 14 covers the entire PIFA 1. Each of the frequency characteristics is calculated by means of the electric field analysis using the finite element method. As is obvious from graphs 500 to 520, it can be understood that, when the insulating material layer 14 is formed to cover the grounding electrode and other sections such as the emitting electrode 12, the $S_{11}$ parameter is larger as compared to when the insulating material layer 14 is formed to cover only the grounding electrode 11, and that the communicating performance of the PIFA 1 is lower.

As indicated by the results of the simulations, it is preferable that the insulating material layer 14 does not surround the emitting electrode 12 and the superstrate 13 and is provided only under the substrate 10. To satisfy the requirement, in this embodiment, the insulating material layer 14 is provided to cover the bottom and side faces of the grounding electrode 11 without surrounding the side face of the substrate 10.

The grounding electrode 11 and the emitting electrode 12 are fixed to the top or bottom surface of the substrate 10 by means of, for instance, etching or adhesion. The substrate 10 and the superstrate 13 also are fixed to each other, for instance, by adhesion. In the same manner, the grounding electrode 11 and the insulating material layer 14 are fixed to each other, for instance, by adhesion.

Figure 6:
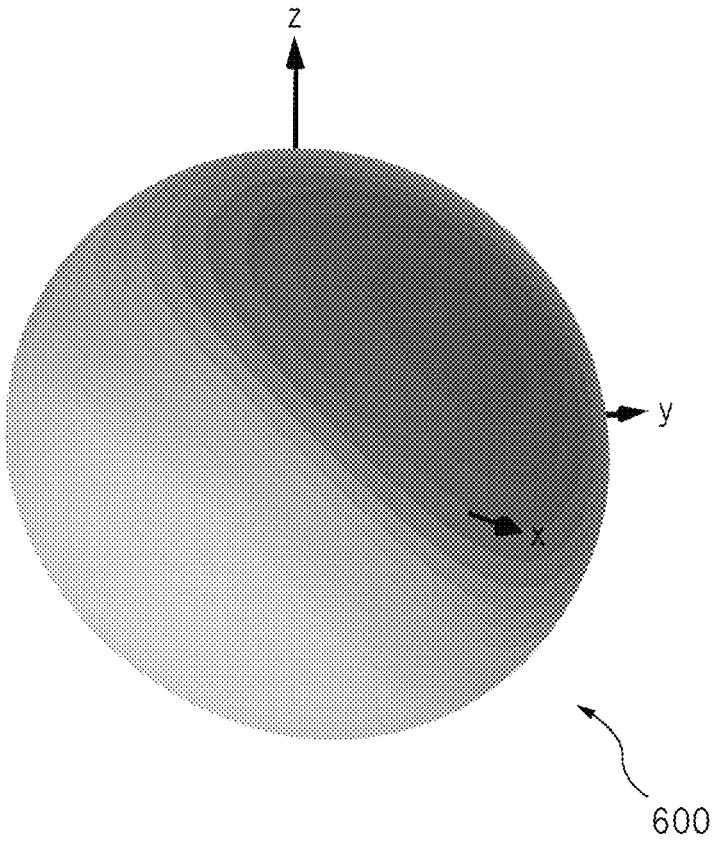
FIG. 6 is a view illustrating a result of simulation for a radiation pattern of electric wave having a frequency of 405 MHz formed around the planar inverted-F antenna.

FIG. 6 is a view illustrating a result of simulation for a radiation pattern of electric wave having a frequency of 405 MHz formed around the PIFA 1. In the simulation, the size of the emitting electrode 12 is as illustrated in FIG. 1, and the sizes and physical characteristics of the substrates are the same as those of the substrates used in the simulations illustrated in FIG. 3. The thickness of the superstrate 13 is 1.5 mm.

In a radiation pattern 600, deeper color represents higher intensity of the electric fields. In this embodiment, between the PIFA 1 and a radio transmitter provided outside the living body in which the PIFA 1 is implanted and positioned away from the PIFA 1 by 9 m, the gain is in the range from about −32 dB to −30 dB.

As described above, the PIFA includes a dielectric layer covering an emitting electrode. Therefore, even when the PIFA is implanted in a living body where electric wave loss is high, reflection of electric wave between the living body and the PIFA is suppressed, which enables communication with a communication device outside the living body. Since this PIFA includes an insulating material layer covering a grounding electrode, it is possible to reduce negative effects by a current flowing through the grounding electrode to the living body. Furthermore, since an emitting electrode in the PIFA is folded into an S-shape, it is possible to make the PIFA compact in the horizontal direction.

Figure 7B:
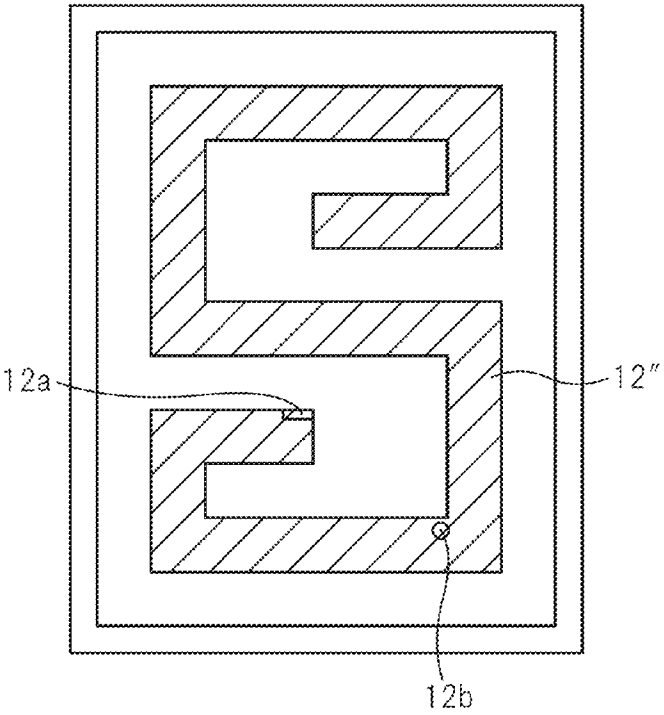
FIG. 7A and FIG. 7B are transparent plan views illustrating the planar inverted-F antenna illustrating forms of emitting electrodes according to modifications, respectively.
Figure 7A:
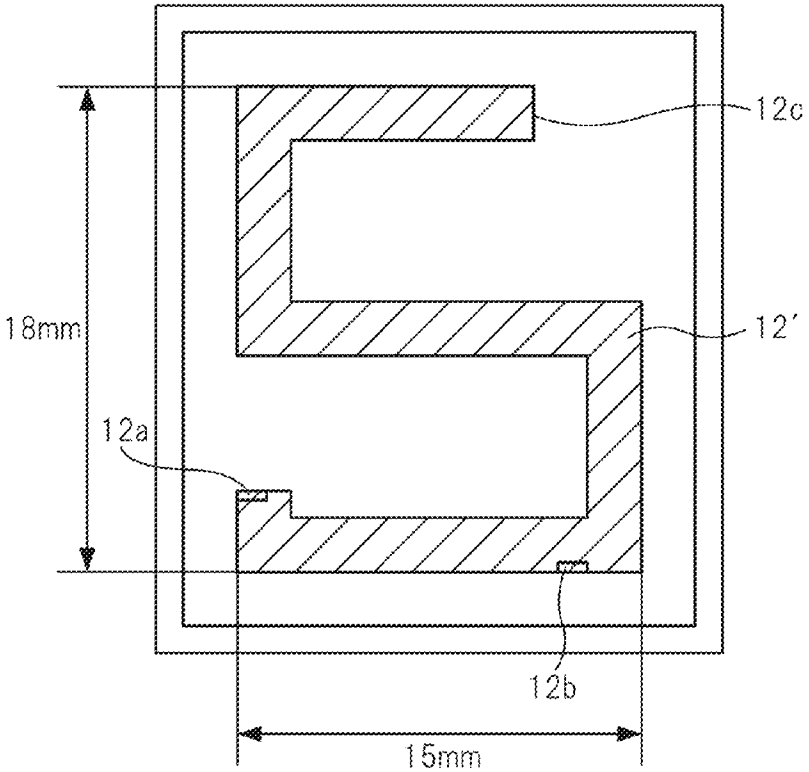

The present invention is not limited to the embodiment described above. FIG. 7A and FIG. 7B are transparent plan views illustrating forms of emitting electrodes of PIFAs according to modifications, respectively. According to the modification illustrated in FIG. 7A, the length of an emitting electrode 12' in the y-axial direction is shorter than that of the emitting electrode 12 illustrated in FIG. 1, while the length thereof in the x-axial direction is longer than that of the emitting electrode 12. In this example, for instance, the length in the x-axial direction is 15 mm, and that in the y-axial direction is 18 mm. In this example, an edge portion 12*c* of the emitting electrode 12' in the opposite side from the short-circuiting point 12*a* is positioned in the inner side from the right edge portion of the emitting electrode 12'. Because of this configuration, the emitting electrode 12' is parallel to the x-axial direction near the edge portion 12*c*.

On the other hand, according to the modification illustrated in FIG. 7B, for the purpose of reducing the size of the PIFA in the horizontal direction, an emitting electrode 12" is further folded in comparison to the emitting electrode 12 illustrated in FIG. 1 so that the portion near an edge of the emitting electrode 12" where the short-circuiting point 12*b* is positioned and the portion near the other edge of the emitting electrode 12" are parallel to the x-axial direction. Because of this configuration, the section of the emitting electrode 12" between the short-circuiting point 12*a* and the feed point 12*b* has a U-shaped form. As a result, five portions of the emitting electrode 12" are parallel to the x-axis, so that the size of the PIFA in the horizontal direction can be reduced.

According to another modification, the emitting electrode may be folded at any angle other than a right angle. Alternatively, the emitting electrode may be a curved line.

Figure 8A:
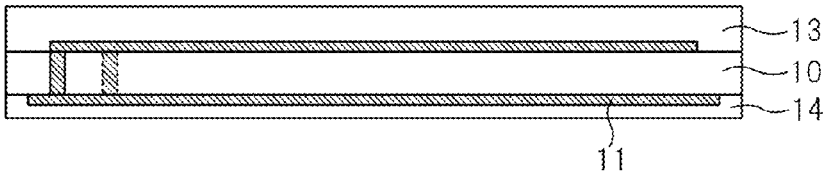
FIG. 8A is a cross-sectional side view of a planar inverted-F antenna according to a modification.

FIG. 8A is a sectional side view of a PIFA in still another modification. According to this modification, the grounding electrode 11 is smaller than the bottom surface of the substrate 10, and the bottom surface of the substrate 10 around the grounding electrode 11 directly and closely contacts the insulating material layer 14. Because of the structure described above, in the PIFA in this modification, the sizes of the substrate 10, the superstrate 13, and the insulating material layer 14 are identical.

Figure 8B:
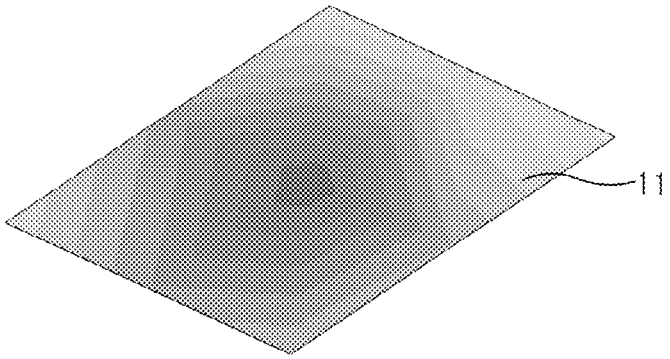
FIG. 8B is a view illustrating a result of simulation for distribution of current densities in a grounding electrode according to the modification.
Figure 8C:
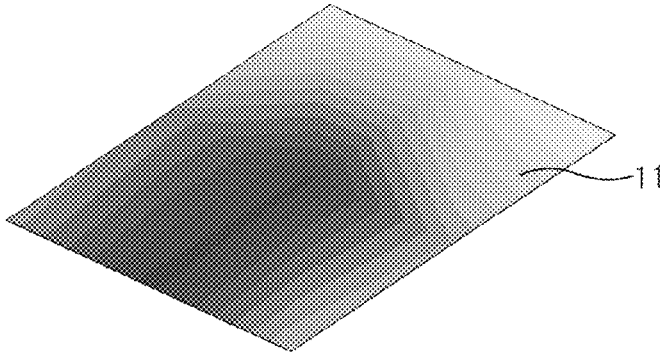
FIG. 8C is a view illustrating, as an example for comparison, a result of simulation for distribution of current densities in a grounding electrode when the grounding electrode covers the entire bottom surface of the substrate.

FIG. 8B is a view illustrating a result of simulation for distribution of current densities in the grounding electrode in the variant illustrated in FIG. 8A. FIG. 8C is a view illustrating, as a comparative example, a result of simulation for distribution of current densities in a grounding electrode when the grounding electrode covers the entire bottom surface of the substrate. In this simulation, it is assumed that the PIFA 1 receives electric waves with a frequency of 405 MHz. It is also assumed that the size of the emitting electrode is as illustrated in FIG. 7A, and the size and physical characteristics of each substrate are the same as employed in the simulation illustrated in FIG. 3. The thickness of the superstrate 13 is 1.5 mm.

In FIG. 8B and FIG. 8C, deeper color represents higher current density. As is obvious from the results of the simulations, it can be understood that, in the configuration in which the grounding electrode 11 is smaller than the bottom surface of the substrate 10, and the bottom surface of the substrate 10 tightly contacts to the insulating material layer 14 around the grounding electrode 11, the current densities in the grounding electrode 11 are generally lower.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention.

Although the embodiments of the present invention have been described in detail, it should be understood that various changes, substitutions, and alterations could be made hereto without departing from the spirit and scope of the invention.

What is claimed is:

1. A planar inverted-F antenna implantable in a living body, comprising:

a first substrate made of a dielectric material;

a grounding electrode disposed on a first surface of the first substrate;

an emitting electrode disposed to be opposite to the grounding electrode so as to sandwich the first substrate, the emitting electrode being in the form of an S-shape, and having a short-circuiting point short-circuited to the grounding electrode at an edge portion thereof, a feed point at which power is fed and which is located away from the short-circuiting point by a distance at which the characteristic impedance of the planar inverted-F antenna for electric waves with a certain design wavelength has a certain value;

a second substrate disposed to cover the entire emitting electrode together with the first substrate, and made of a dielectric material; and an insulating material layer disposed to cover the entire grounding electrode together with the first substrate and insulating a living body in which the planar inverted-F antenna is implanted from the grounding electrode, wherein the dielectric constant of the insulating material layer is lower than the dielectric constants of the first substrate and the second substrate.

2. The planar inverted-F antenna according to claim 1, wherein the emitting electrode is folded so that the edge portion of the emitting electrode where the short-circuiting point is located and the other edge portion of the emitting electrode are opposed to each other.

3. The planar inverted-F antenna according to claim 1, wherein a section from the edge portion of the emitting electrode where the short-circuiting point is located to the feed point of the emitting electrode has a U-shaped form.

* * * * *